US006877920B2

(12) United States Patent
Fujioka

(10) Patent No.: US 6,877,920 B2
(45) Date of Patent: Apr. 12, 2005

(54) ROLL-LIKE FIXING-MEDIUM HOLDING DEVICE AND LIQUID FIXING APPARATUS

(75) Inventor: Satoshi Fujioka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/392,327

(22) Filed: Mar. 20, 2003

(65) Prior Publication Data

US 2003/0210312 A1 Nov. 13, 2003

(30) Foreign Application Priority Data

Mar. 20, 2002 (JP) ..... P2002-077638

(51) Int. Cl.[7] ..... B41J 11/26

(52) U.S. Cl. ..... 400/613; 242/423.2; 347/104; 101/407.1

(58) Field of Search ..... 101/407.1; 400/207, 400/208, 208.1, 242, 236.1, 613; 242/596.1, 419.1, 432.2; 347/104; 358/400

(56) References Cited

U.S. PATENT DOCUMENTS 4,948,064 A * 8/1990 Richard ..... 242/423.2
5,813,343 A * 9/1998 Harb ..... 101/407.1
5,911,382 A * 6/1999 Wilson ..... 242/419.6
6,069,711 A * 5/2000 Iwata ..... 358/400
6,183,153 B1 * 2/2001 Kamoda et al. ..... 400/613
6,503,008 B2 * 1/2003 Zevin et al. ..... 400/613

FOREIGN PATENT DOCUMENTS

JP 11-322142 11/1999

OTHER PUBLICATIONS

2001/0024575 9/01 Fukugawa et al 396/512.*

* cited by examiner

*Primary Examiner*—Eugene H. Eickholt
(74) *Attorney, Agent, or Firm*—Sughrue Mion, PLLC

(57) ABSTRACT

A holding device is provided with adapters capable of dealing with a case where the hollow shaft portions of a roll-like fixing medium differ in inner diameter. Thus, it is unnecessary to have a complete set of roll paper supporting members to be used every time the hollow shaft portions of the roll-like fixing medium differ in inner diameter. As the size of such an adapter can be made at least smaller than the size of the roll paper supporting members, the adapter is easily stocked under control.

20 Claims, 13 Drawing Sheets

ROLL-LIKE FIXING-MEDIUM HOLDING DEVICE AND LIQUID FIXING APPARATUS

The present application is based on Japanese Patent Application No. 2002-77638, the entire contents of which are incorporated herein by reference.

BACKGROUND OF THE INVENTION

1. Field of the Invention

The present invention relates to a roll-like fixing-medium holding device and a liquid fixing apparatus fitted with the holding device.

2. Related Art

One of the conventional large printers is generally provided with a feeding unit for supplying, for example, a roll of recording paper as a recording medium, a recording unit for recording information on the roll paper supplied and a discharging unit for taking off the roll paper printed with the information in descending order. When such a large ink-jet printer is employed, the user puts the roll paper into the feeding unit and pulls out the front end portion of the roll paper. Then the user leads the front end portion of the roll paper outward along a flat feed guide that functions as a paper carrier face and puts the roll paper between a feed roller and a driven roller before starting the ink-jet printer.

While sending out the roll paper onto a flat platen that functions as a paper carrier guide face by rotating the feed roller, the ink-jet printer jets out ink drops from the nozzle tips of recording heads so as to record information on the roll paper. Further, the ink-jet printer discharges the roll paper via a flat discharge guide that functions as a paper carrier face with a taking-off roller being rotated.

When the roll paper is put into the feeding unit of the conventional ink-jet printer, a spindle is inserted into the hollow shaft portion of the roll paper and inserted thereinto first and a pair of flange-like roll paper supporting members are fitted to both end portions of the spindle. Further, both ends of the spindle are suspended by a pair of spindle receivers disposed in the feeding unit.

Roll paper having a hollow shaft portion of two inches in inner diameter and roll paper having a hollow shaft portion of three inches in inner diameter are usable in the ink-jet printer and special roll paper supporting members are to be used depending on the roll paper for use. Consequently, it has been troublesome to stock bulky roll paper supporting members under control.

SUMMARY OF THE INVENTION

An object of the invention made in view of the foregoing problems is to provide a holding device capable of holding roll-like recording media having hollow shaft portions different in inner diameter and a liquid fixing apparatus provided with the holding device.

(1) In order to accomplish the object above, a roll-like fixing-medium holding device for rotatably holding a roll-like fixing medium according to the invention has at least one adapter capable of dealing with a case where the hollow shaft portions of a roll-like fixing medium differ in inner diameter. In other words, the adapter is capable of attaching a hollow shaft portion of the roll-like fixing medium whose inner diameter differs from an inner diameter of a regular roll-like fixing medium.

The adapter is separately formed from the supporting member and is detachably mounted on the supporting member. Thus, one fixing medium including a hollow shaft portion having a first inner diameter is attachable to the supporting member without mounting the adapter on said supporting member, and another fixing medium including a hollow shaft portion having a second inner diameter, which is different from the first inner diameter, is attachable to the supporting member by mounting the adapter on said supporting member.

(2) In order to accomplish the object above, a roll-like fixing-medium holding device according to the invention comprises a shaft which is inserted into the hollow shaft portion of a roll-like fixing medium and supporting members which are respectively fitted in both end portions of the hollow shaft portion of the roll-like fixing medium with the shaft inserted thereinto and used to hold down the roll-like fixing medium, wherein adapters which are fitted to the respective supporting members and inserted into the hollow shaft portion of the roll-like fixing medium are provided when the hollow shaft portions of the roll-like fixing medium differ in inner diameter. Thus, it is unnecessary to have a complete set of roll paper supporting members to be used for a roll-like fixing-medium holding device and liquid fixing apparatus every time the hollow shaft portions of the roll-like fixing medium differ in inner diameter. As the size of such an adapter can be made at least smaller than the size of the roll paper supporting members, the adapters are easily stocked under control.

(3) According to the invention, the roll-like fixing-medium holding device is such that slits axially extended are formed in the adapter so that the adapter is elastically deformable in the diametric direction. As the adapter is diametrically C-shaped in section and readily subjected to diametrical elastic deformation to the extent of the gap, variation in the inner diameter of the hollow shaft portion of the roll-like fixing medium can be adapted.

(4) A liquid fixing apparatus according to the invention may be equipped with the roll-like fixing-medium holding device as described above, whereby the liquid fixing apparatus capable of making effective each of the actions as described above.

DETAILED DESCRIPTION OF THE PREFERRED EMBODIMENTS

An embodiment of the invention will now be described in detail with reference to the drawings.

Figure 1:
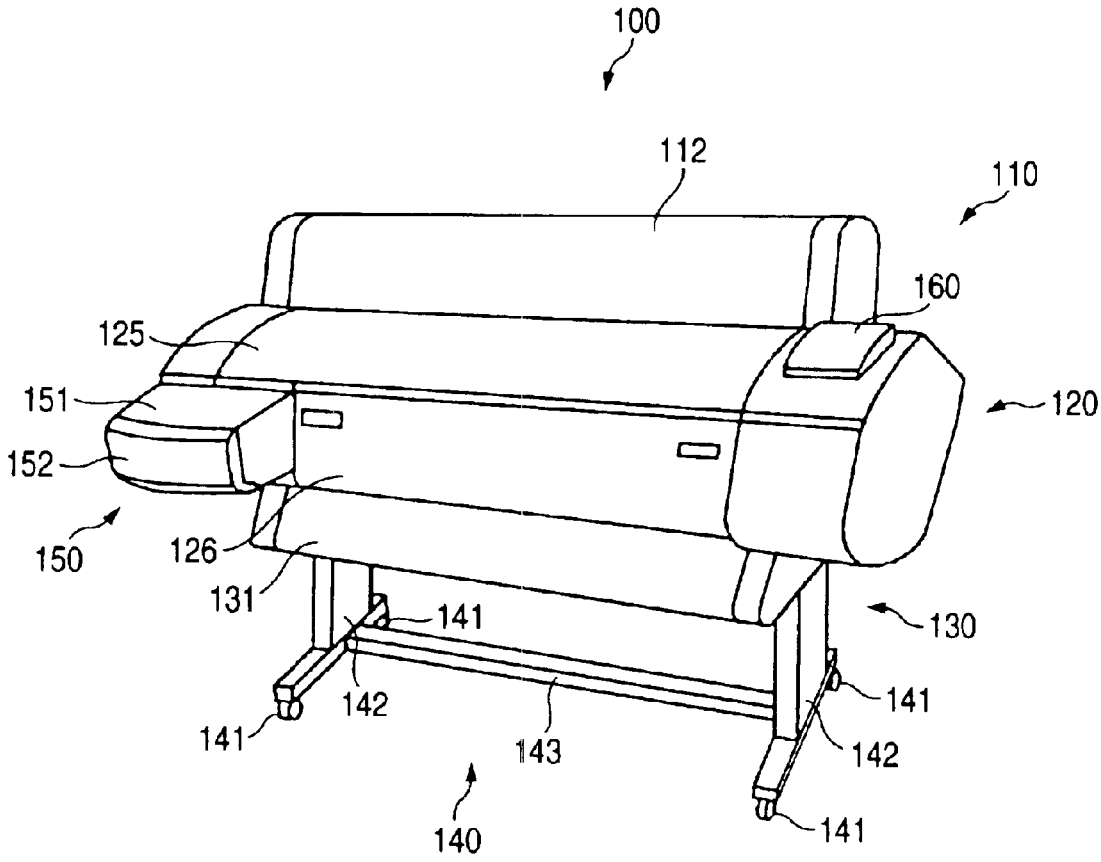
FIG. 1 is a perspective view of the construction of an ink-jet printer as a liquid fixing apparatus according to an embodiment of the invention.
Figure 2:
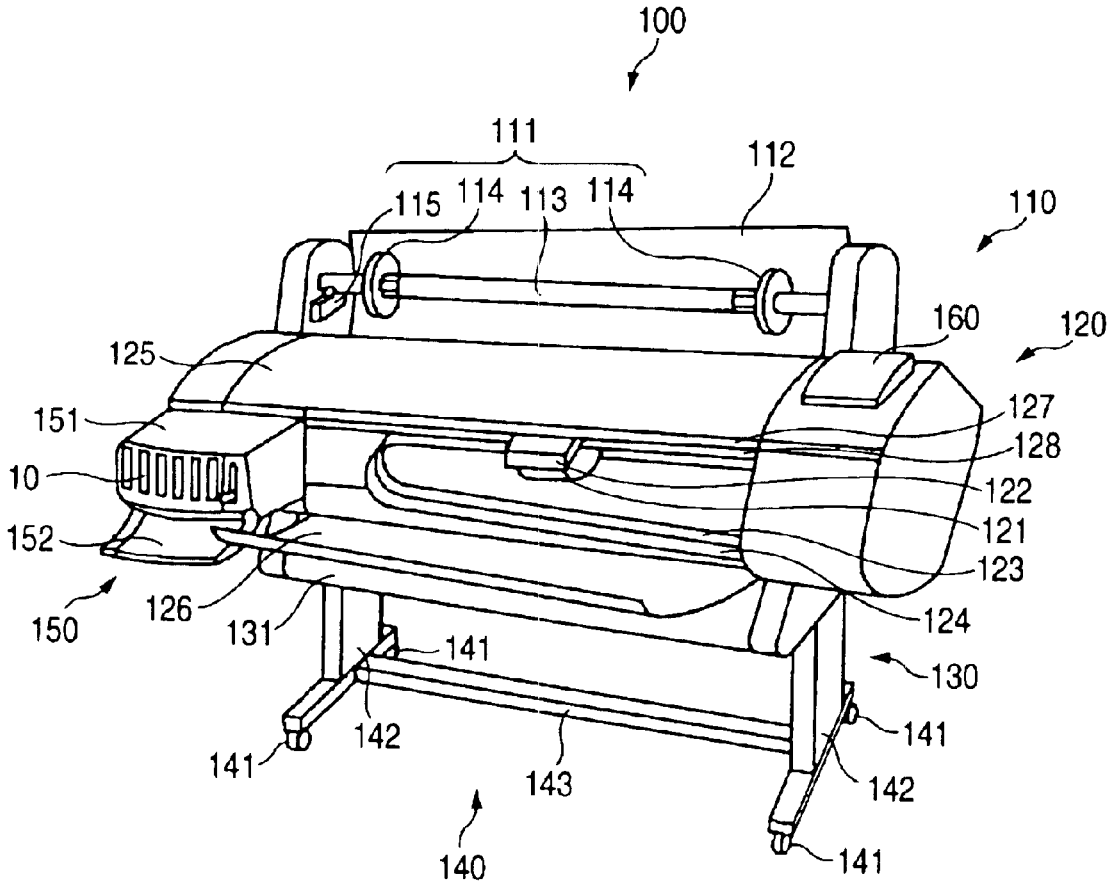
FIG. 2 is a perspective view of the internal structure of the principal part of the ink-jet printer of FIG. 1.

FIG. 1 is a perspective view of the construction of an ink-jet printer as one liquid fixing apparatus according to an embodiment of the invention; and FIG. 2, a perspective view of the internal structure of the principal part of the ink-jet printer. The ink-jet printer 100 shown in FIGS. 1 and 2 is a large printer capable of recording information on relatively large-sized recording paper (fixing medium) of from A1 up to B1 size according to the JIS, for example, and provided with a feeding unit 110, a recording unit 120 as fixing unit, a discharging unit 130 and a leg portion 140 in descending order. The recording unit 120 is integrated with the discharging unit 130 to form a printer body proper, whereas the feeding unit 110 and the leg portion 140 are each made separable from the body.

Figure 11:
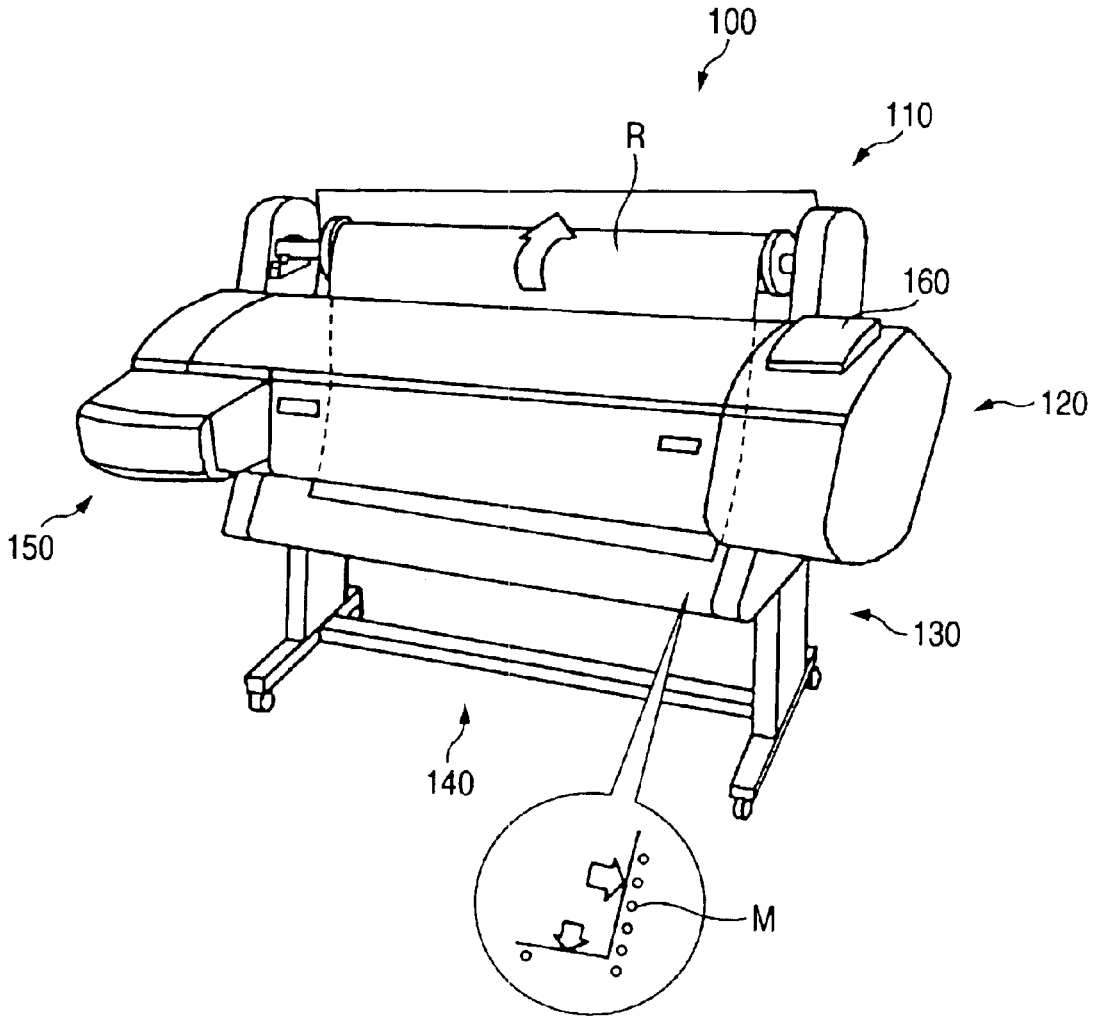
FIG. 11 is a ninth diagram showing the step of operating the ink-jet printer of FIG. 1.

As shown in FIG. 11, the feeding unit 110 is provided in such a manner as to project rearward toward the upper portions of the bodies 120 and 130. Further, a roll paper holder 111 is as shown in FIG. 2 provided so that recording paper in the form of one roll (hereinafter called the roll paper) can be set onto the roll paper holder 111. As shown in FIGS. 1 and 2, a flap roll paper cover 112 that can be opened and closed is mounted on the front of the feeding unit 110 in a manner covering the roll paper holder 111.

The roll paper holder 111 is as shown in FIG. 2 provided with a spindle 113 for holding the roll paper and a pair of flange-like roll paper supporting members 114 and a pair of spindle receivers 115 that are respectively mounted on both inner side wall surfaces of the feeding unit 110 and capable of making the spindle 113 detachable and suspensible. Both sides of the spindle 113 are placed and held on the spindle receivers 115 with the roll paper centrally fitted in and held between the roll paper supporting members 114 and pivotally and rotatably supported. The whole roll paper cover 112 is as shown in FIGS. 1 and 2 pivotably supported and opened or closed when the user raises or holds down the lower portion of the cover while holding the lower portion of the cover.

The recording unit 120 is as shown in FIG. 2 provided with a carriage 122 for carrying recording heads 121, a flexible flat cable (hereinafter called the FFC) 123 for electrically connecting the recording heads 121 and a control unit (not shown) for causing recording operation to be performed, ink tubes 124 for connecting the recording heads 121 and ink cartridges 10 filled with ink, a feed roller (not shown) for carrying the roll paper in the subscanning direction, a paper drawing device (not shown) for preventing the roll paper from floating up and so forth. An upper cover 125 and a front cover 126 are as shown in FIGS. 1 and 2 mounted onto the top surface and the front of the recording unit 120 so as to cover the recording heads 121 and the carriage 122.

The recording heads 121 include a black-ink recording head for jetting out black ink and a plurality of color-ink recording heads for jetting out ink of different colors such as light yellow, yellow, light cyan, cyan, light magenta and magenta. Moreover, the recording head 121 is provided with a pressure generating chamber and nozzles coupled to the pressure generating chamber. Large ink drops are jetted out under control from the tips of the nozzles toward the roll paper by pressurizing the ink stored in the pressure generating chamber at a predetermined pressure.

The carriage 122 is as shown in FIG. 2 suspended via a roller from a rail 127 provided in the main scanning direction and coupled to a carriage belt 128. When the carriage belt 128 is put into operation by a carriage drive (not shown), the carriage 122 is taken along with the movement of the carriage belt 128 and guided by the rail 127 so as to make a reciprocating motion.

One end of the FFC 123 is connected to the connector of the control unit and the other end is connected to the connectors of the recording heads 121, so that recording signals are sent from the control unit to the recording heads 121. The ink tubes 124 for different colors are disposed and one end of each ink tube 124 is connected to the ink cartridge 10 for corresponding color via an ink pressurizing/supplying device (not shown) whereas the other end of the ink tube 124 is connected to the recording head 121 for corresponding color. The ink tubes 124 are so arranged as to send the pressurized ink of corresponding color from the ink cartridges 10 to the respective recording heads 121.

The lower portion of the front cover 126 is as shown in FIGS. 1 and 2 pivotably supported and opened or closed when the user holds down or pushes up the upper portion of the front cover 126 while holding the upper portion thereof. As the user is able to open the recording unit 120 widely by opening the front cover 126, the user can easily do the maintenance of the recording heads as well as the carriage 122.

The discharging unit 130 is as shown in FIGS. 1 and 2 provided with a discharge guide 131 forming part of the path through which the roll paper is carried in the subscanning direction and a taking-off roller (not shown) for carrying the roll paper in the subscanning direction. The discharge guide 131 is in the form of a flat slope protruding toward the front side so that the roll paper carried from above is smoothly led downward.

The leg portion 140 is as shown in FIGS. 1 and 2 provided with two support legs 142 having casters 141 for moving the support legs and a reinforcing bar 143 placed between the support legs 142. The feeding unit 110 and the bodies 120 and 130 are loaded on and secured to the support legs 142 with screws. With the casters 141 for moving the support legs 142, the heavy feed unit 110 and the bodies 120 and 130 can be moved smoothly to a desired position and installed therein. In this case, a feeder output receptacle for receiving the roll paper discharged from the discharging unit 130.

A holder body 151 for containing and holding the ink cartridges 10 for different colors and an ink cartridge holder 150 having a cover 152 for covering the front of the holder body 151 are as shown in FIGS. 1 and 2 disposed on the left-hand side as seen from the front side of the bodies 120 and 130. The lower portion of the cover 152 is pivotably supported with the holder body 151 of the ink cartridge holder 150, so that the cover 152 is opened and closed when the user holds down or pushes up the upper portion of the cover while holding the upper portion thereof.

An operation panel 160 for the user to perform recording control and the like is as shown in FIGS. 1 and 2 disposed in the upper portion on the right-hand side as seen from the front side of the bodies 120 and 130. A liquid crystal screen and various buttons are disposed on the operation panel 160 and the user is allowed to push buttons while looking at the screen for confirmation.

Figure 3:
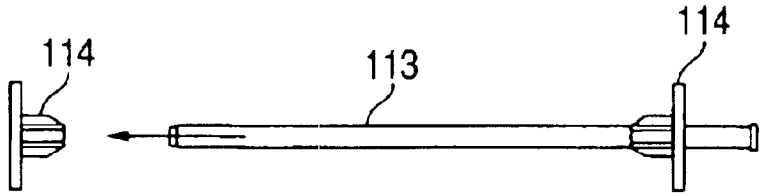
FIG. 3 is a first diagram showing the step of operating the ink-jet printer of FIG. 1.

When the ink-jet printer 100 thus arranged is used, the spindle 113 forming the roll paper holder 111 is taken out of the feeding unit 110 first and one of the roll paper supporting members 114 fitted into the spindle 113 is pulled out from one end of the spindle 113 as shown in FIG. 3.

Figure 4:
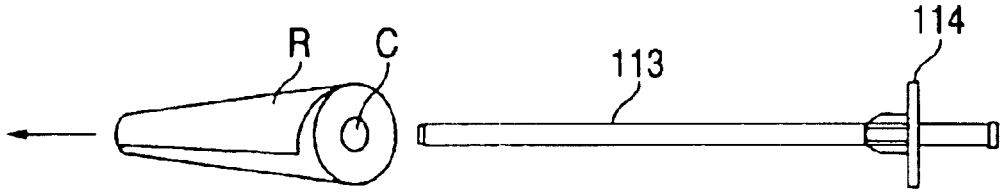
FIG. 4 is a second diagram showing the step of operating the ink-jet printer of FIG. 1.
Figure 5:
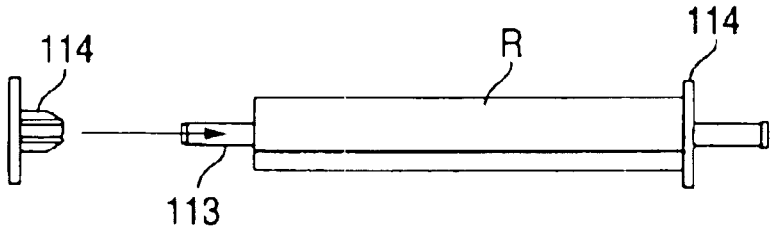
FIG. 5 is a third diagram showing the step of operating the ink-jet printer of FIG. 1.

One end of the spindle 113 is as shown in FIG. 4 inserted from one end of the shaft hole C of roll paper R and inserted thereinto and one end of the shaft hole C of the roll paper R is as shown in FIG. 5 inserted in the other roll paper supporting member 114 fixedly inserted into the other end side portion of the spindle 113 before being brought into contact with the other roll paper supporting member 114. Then the one roll paper supporting member 114 is inserted from the one end of the spindle 113 and fitted in the other end portion of the shaft hole C of the roll paper R. The roll paper R is thus made rotatable together with the roll paper R or the spindle 113.

Figure 6:
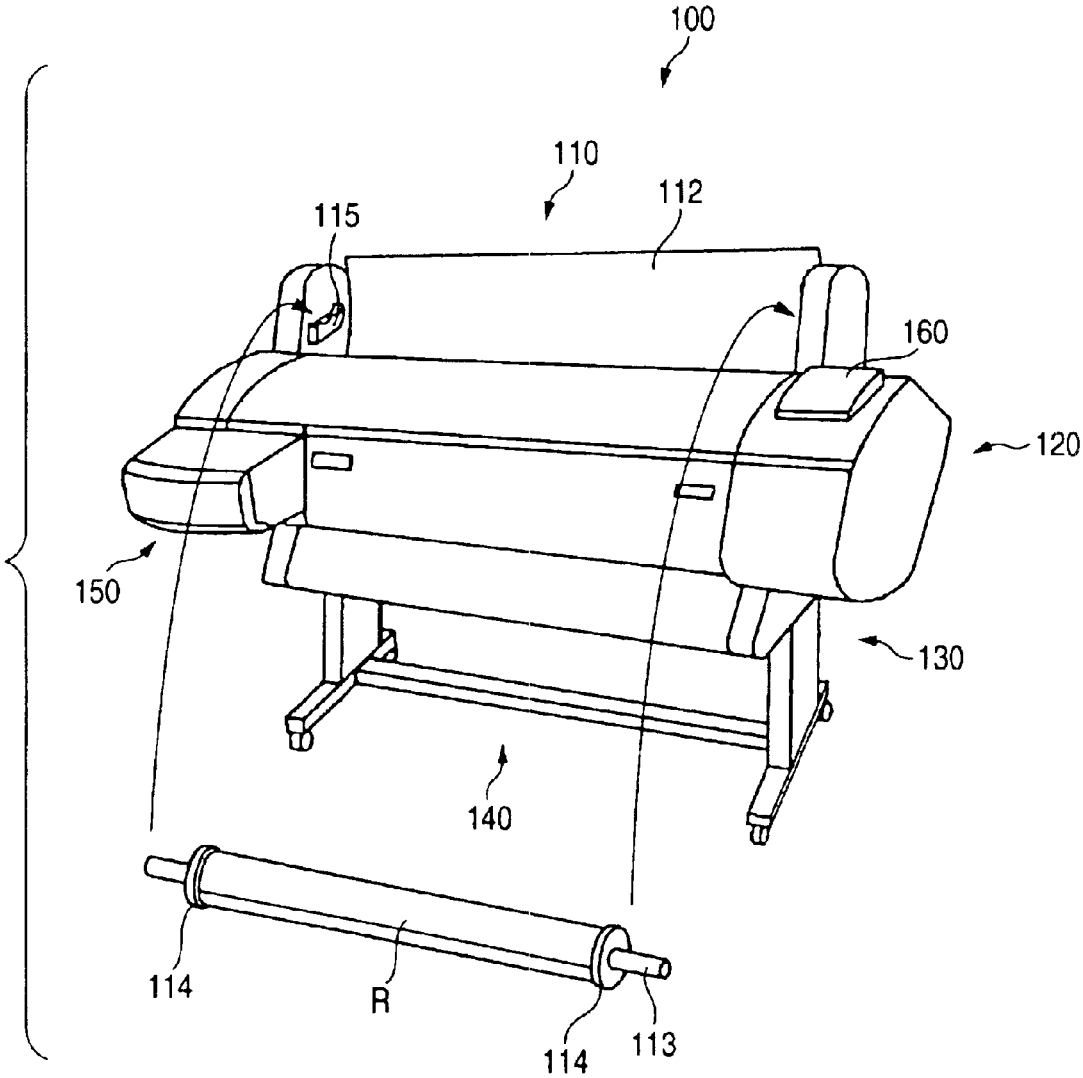
FIG. 6 is a fourth diagram showing the step of operating the ink-jet printer of FIG. 1.
Figure 7:
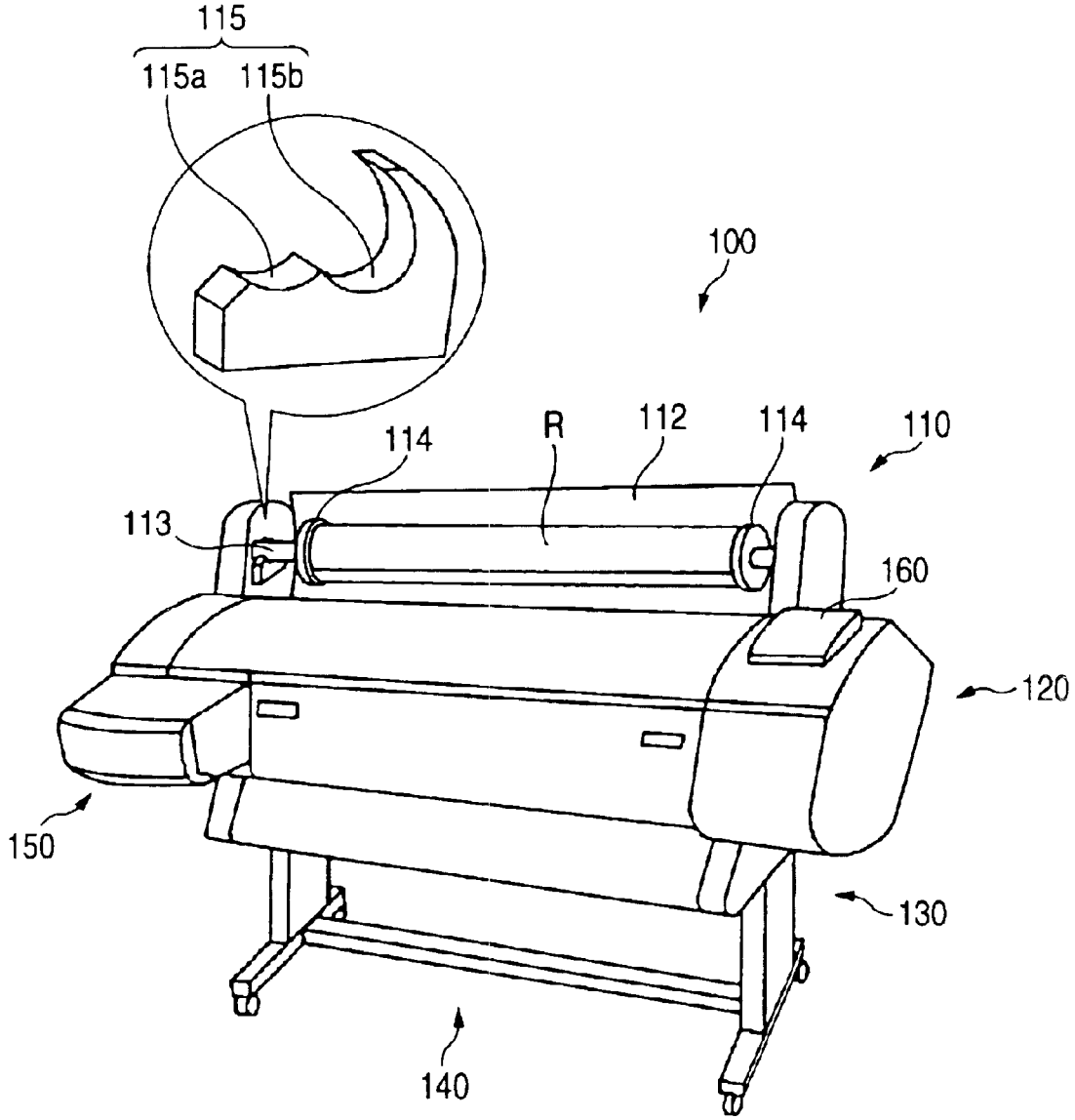
FIG. 7 is a fifth diagram showing the step of operating the ink-jet printer of FIG. 1.

Then both ends of the spindle 113 inserted into the shaft hole of the roll paper R are as shown in FIG. 6 taken up and lifted up to the feeding unit 110. As shown in FIG. 7, further, a relatively shallow recess 115*a* for temporarily receiving and holding the end portion of the spindle 113 and a relative deep recess 115*b* for rotatably supporting the end portion of the spindle 113 by means of a shaft are longitudinally provided side by side in each spindle receiver 115. The recesses 115*a* on this side are used for temporarily receiving the spindle 113 since it is difficult to fit the spindle 113, which is inserted into the shaft hole of the heavy roll paper R, in the regular recess 115*b* at one time.

Figure 8:
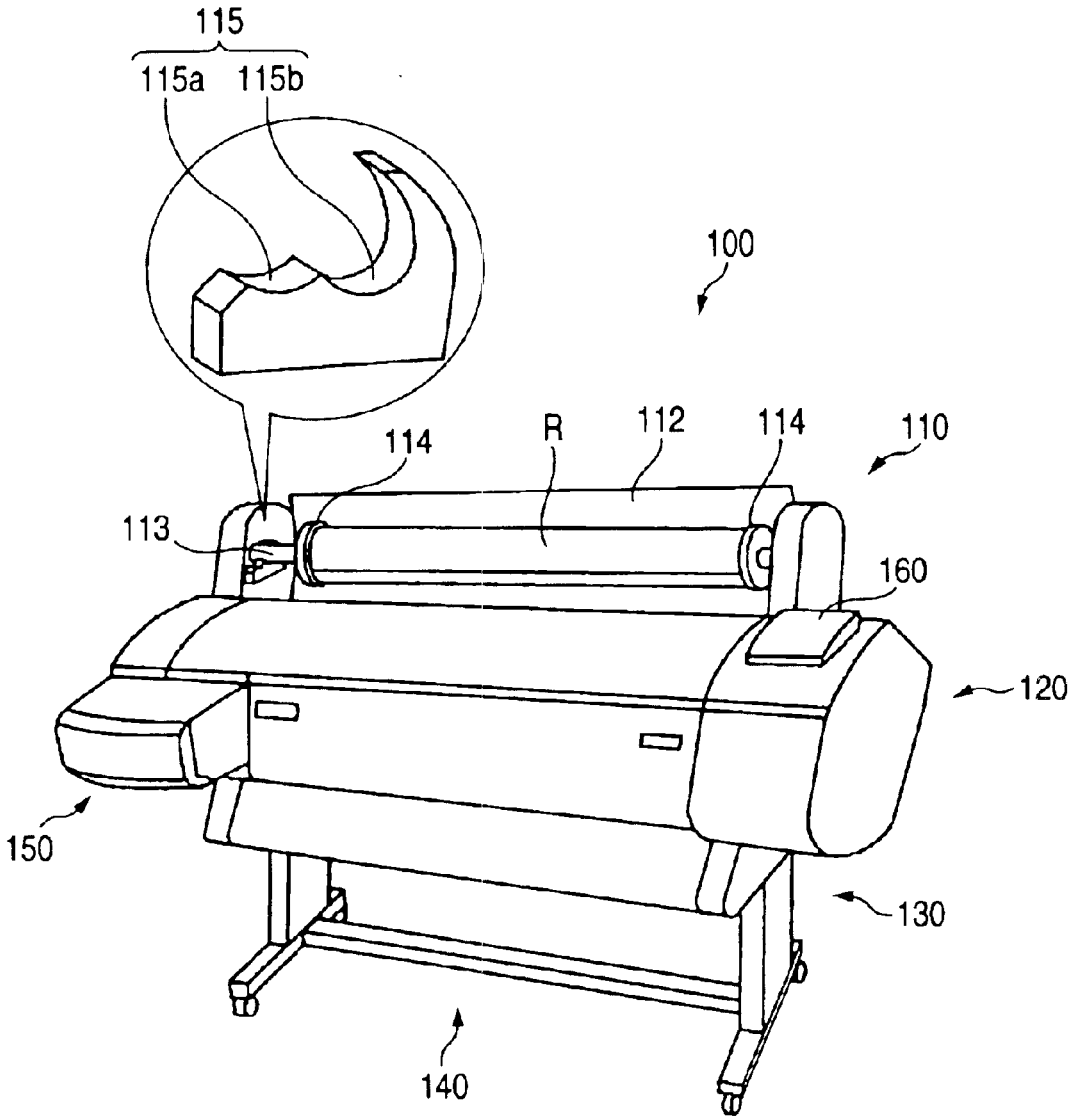
FIG. 8 is a sixth diagram showing the step of operating the ink-jet printer of FIG. 1.

Accordingly, as shown in FIG. 7, both ends of the spindle 113 inserted into the roll paper R are placed in the temporarily-usable recesses 115*a* of the spindle receivers 115 once and as shown in FIG. 8 one end portion of the spindle 113 inserted into the shaft hole of the roll paper R is latched onto the regular recess 115*b* of the corresponding spindle receiver 115 and then the other end portion of the spindle 113 inserted into the shaft hole of the roll paper R is latched onto the regular recess 115*b*. Thus, the spindle 113 inserted into the shaft hole of the roll paper R can be set in the feeding unit 110 easily and safely.

Figure 9:
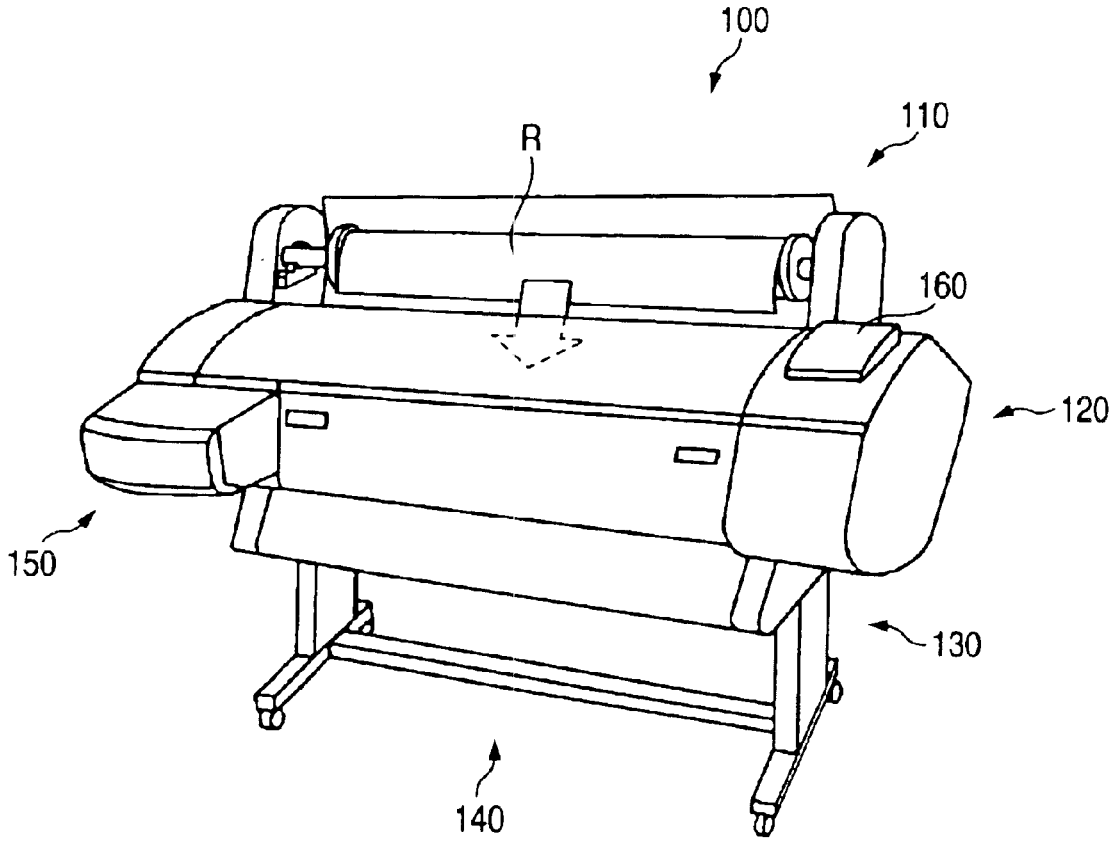
FIG. 9 is a seventh diagram showing the step of operating the ink-jet printer of FIG. 1.
Figure 10:
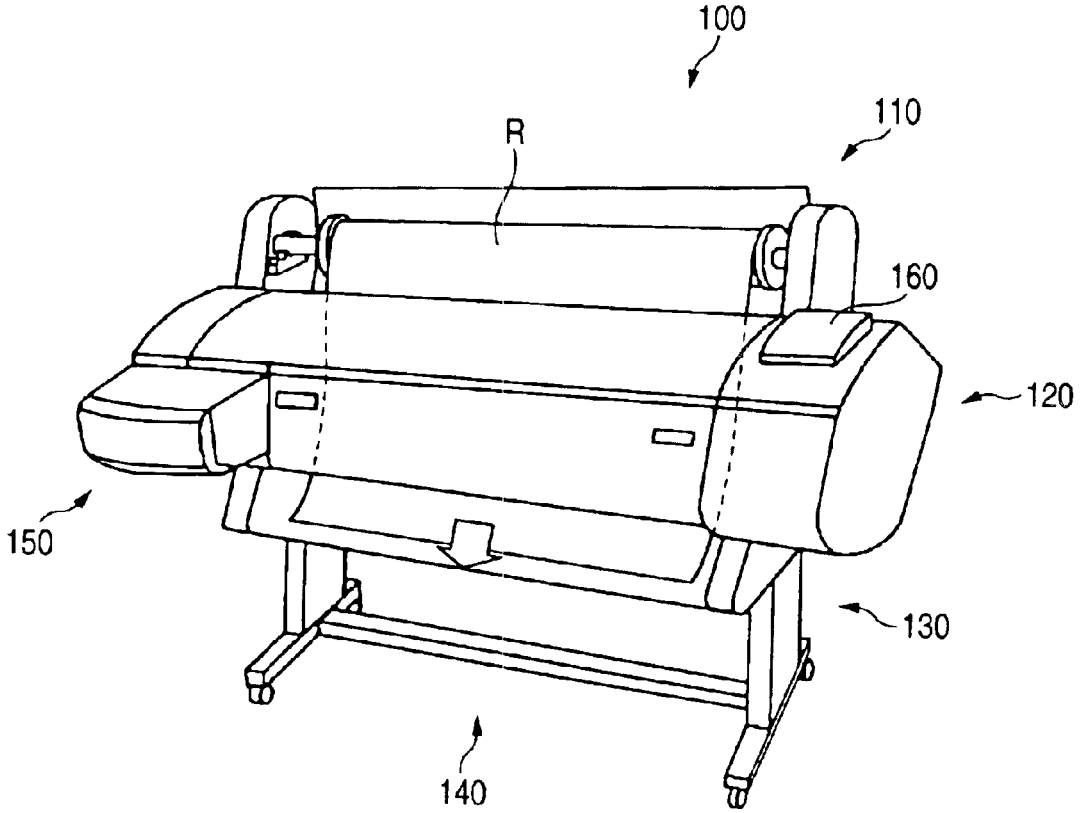
FIG. 10 is a eighth diagram showing the step of operating the ink-jet printer of FIG. 1.

As shown in FIG. 9, the front end of the roll paper R is drawn downward and inserted into the carrier path of the recording unit 120 and further as shown in FIG. 10 inserted up to the carrier path of the discharging unit 130. As shown in FIG. 11, moreover, the roll paper R is turned in the winding direction and the front end of the roll paper R is positioned at a marker M formed on the discharge guide 131, for example. Then the ink-jet printer 100 is started and ink drops are jetted out while the recording head 121 is being moved in the main scanning direction with the roll paper R fed in the subscanning direction. Predetermined information is thus recorded on the roll paper R, which is then discharged from the discharging unit 130.

Figure 12:
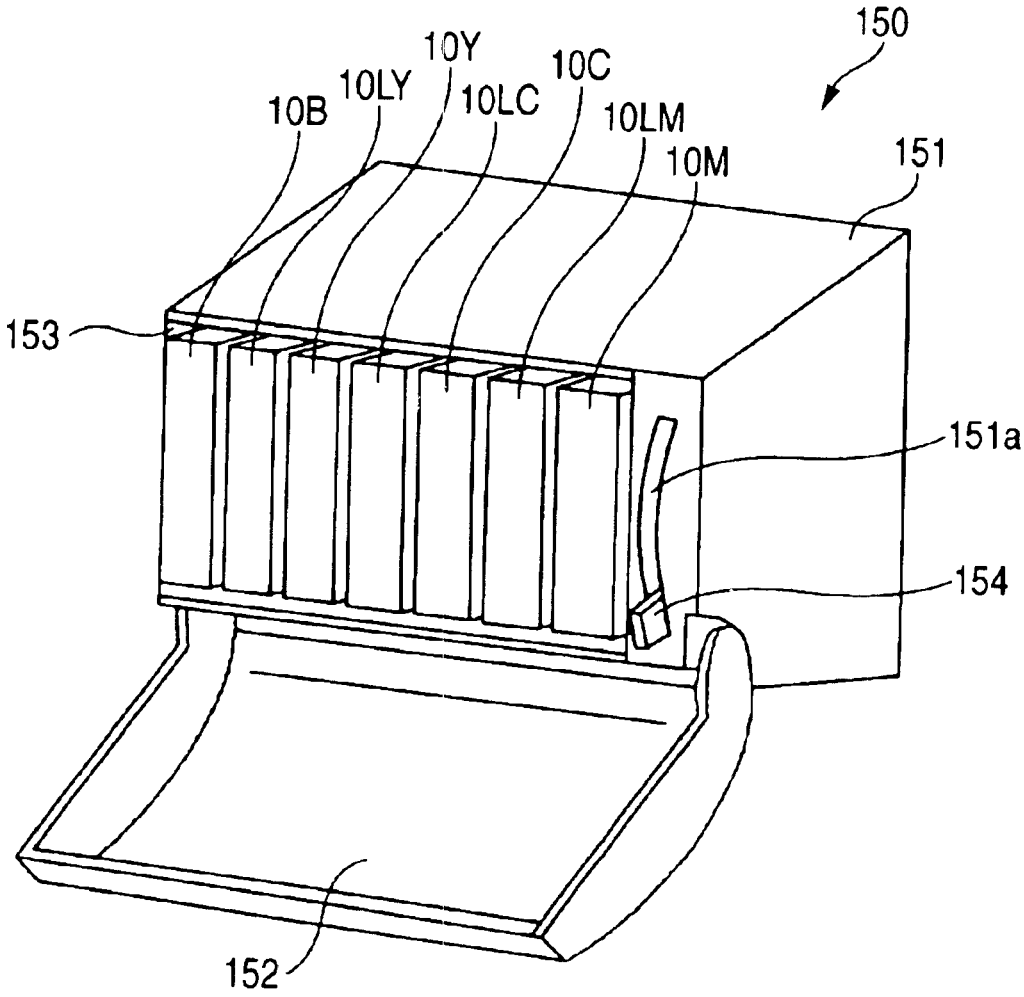
FIG. 12 is a detailed perspective view of the ink cartridge holder of the ink-jet printer of FIG. 1.

FIG. 12 is a detailed perspective view of the ink cartridge holder 150. The ink cartridge holder 150 is provided with the holder body 151 mounted on the left-hand side of the front of the body 120 of the ink-jet printer 100 and the cover 152 mounted on the front side of the holder body 151. Housings 153 for containing the ink cartridges 10 and a control lever 154 that is movable vertically are placed side by side in the holder body 151. The lower portion of the cover 152 is rotatably supported with the lower portion of the holder body 151 and the cover 152 is turned downward to open the front of the holder body 151 and also turned upward to close the front of the holder body 151.

The housings 153 within the holder body 151 are partitioned so that the ink cartridges 10B, 10LY, 10Y, 10LC, 10C, 10LM AND 10M of black, light yellow, yellow, light cyan, cyan, light magenta and magenta, seven colors in total, in leftward order can individually be drawn out and pushed in.

Figure 13:
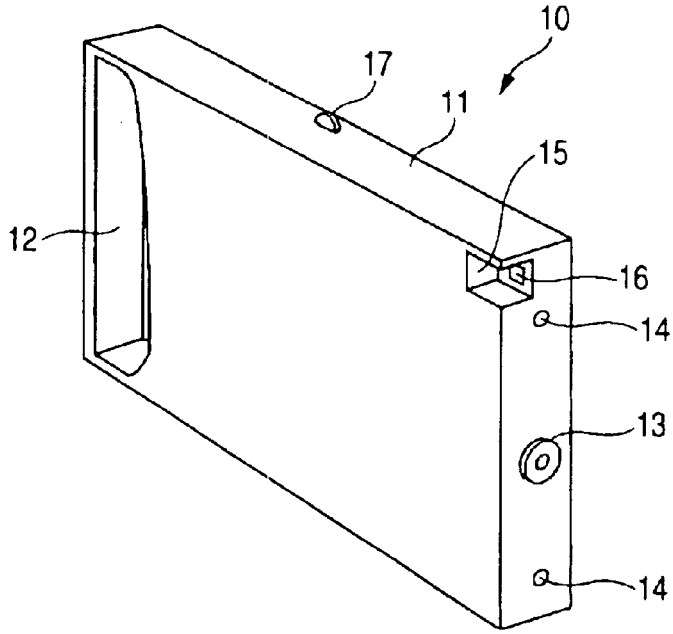
FIG. 13 is a perspective view of an ink cartridge loaded in the ink cartridge holder of FIG. 12 as seen from the back.

FIG. 13 is a perspective view of the ink cartridge 10 as seen from the back. In the ink cartridge 10, an ink tank in the form of a bag made of flexible material, for example, and filled with ink is made airtightly sealed up within a casing 11 in the form of a rectangular parallelepiped made of hard plastic material, for example. A recessed grip portion 12 to be hitched by the user when the ink cartridge 10 is drawn out from and pushed into the housing 153 is formed in the front side and one side of each casing 11.

Only ink cartridges of six colors, for example, have been contained in the holder body of the conventional ink cartridge holder and the holder body still has space to spare. Consequently, the user is allowed to put the hand into the holder body and carry out the work of drawing out and pushing the ink cartridge from and into the housing. However, since it is necessary to put the housings 153 for containing the ink cartridges of seven colors and the control lever 154 side by side within the holder body 151 of the ink cartridge holder 150 equal in size to the conventional ink cartridge holder according to this embodiment of the invention, no margin will be left for space. Consequently, the work of drawing out and pushing the ink cartridge 10 from and into the housing 153 can easily be done by forming the recessed grip portion 12 in each ink cartridge 10.

An ink supply port 13 covered with rubber packing and connected to the inner ink tank is formed in the central portion of the back of each casing 11 and a positioning hole 14 for positioning the ink cartridge when the ink cartridge 10 is pushed into the housing 153 is formed on both the upper and lower sides of one side of the ink cartridge 10. Further, a recess 15 is formed in the upper portion of the back of the casing 11 and a read/write IC 16 with respect to information about ink in the ink cartridge 10 such as the serial number, color and residue of ink and so forth is attached thereto. Moreover, a latch projection 17 for latching the ink cartridge 10 that is put into the housing 153 is formed in the central portion of the top face of the casing 11.

Figure 14:
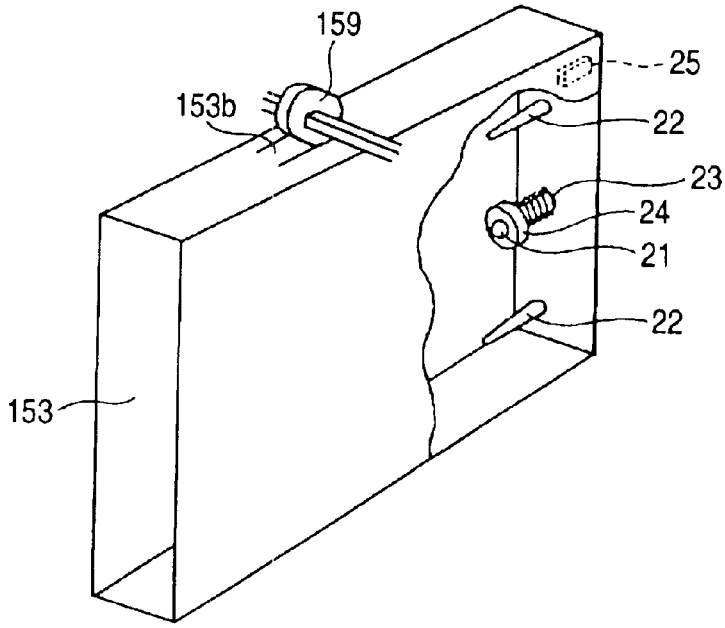
FIG. 14 is a perspective view of the internal structure of the housing of the ink cartridge of one color in the holder body of the ink-jet printer of FIG. 12.

FIG. 14 is a perspective view of the internal structure of the housing 153 of the ink cartridge 10 of one color in the holder body 151. An ink supply needle 21 to be inserted into the ink supply port 13 of the ink cartridge 10 and a positioning needle 22 to be inserted into the positioning hole 14 of the ink cartridge 10 are disposed on the back of the inside of the housing 153 so as to project in the direction of drawing out and pushing in the ink cartridge 10.

Figure 15A:
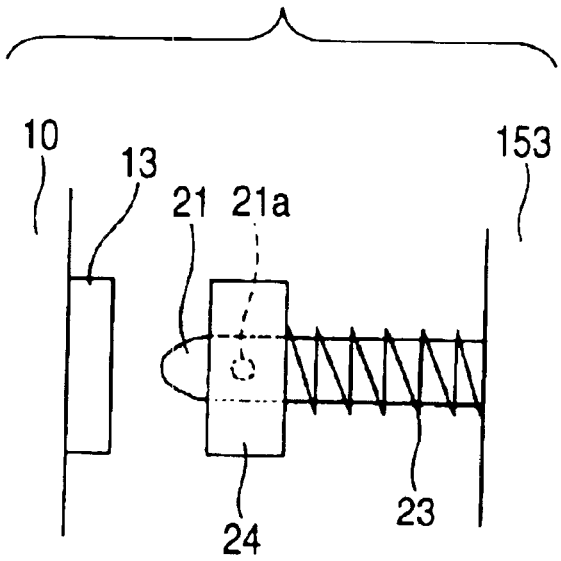
FIGS. 15A–15B are detailed plan views of an ink supply needle in the housing of the ink cartridge of FIG. 14.

FIG. 15A is a detailed plan view of the ink supply needle 21. The ink supply needle 21 has a supply port 21*a* bored in the front end side portion with the rear end connected to the ink tube 124. A cylindrical rubber valve 24 not only axially urged by a compression spring 23 attached to the rear end side of the ink supply needle 21 but also used to close the supply port 21*a* bored in the front end side portion is put on the ink supply needle 21. Thus, the ink supply system within the ink-jet printer 100 maintains a closed condition.

Figure 15B:
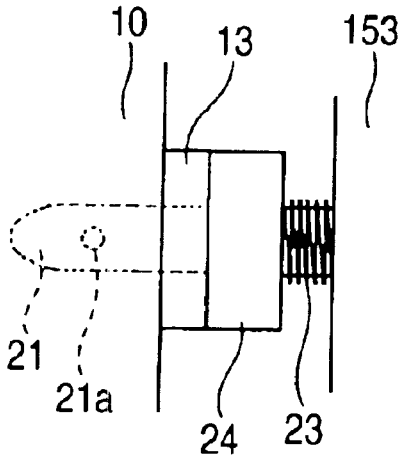

With the arrangement above, when the user pushes the ink cartridge 10 into the housing 153 as shown in FIG. 15A, the ink supply needle 21 is inserted into the ink supply port 13 as shown in FIG. 15B. Simultaneously, the valve 24 is pushed by the rubber packing of the ink supply port 13 and forced into the rear end side of the ink supply needle 21. As the supply port 21*a* covered with the valve 24 is exposed, ink within the ink tank of the ink cartridge 10 is supplied from the ink supply port 13 via the supply port 21*a* of the ink supply needle 21 into the ink tube 124.

When the user draws out the ink cartridge 10 from the housing 153, on the other hand, the ink supply needle 21 is also drawn out from the ink supply port 13, whereby the valve 24 pushed down by the rubber packing of the ink supply port 13 is pushed out toward the front end of the ink supply needle 21 by the restoring force of the compression spring 23. Thus, the exposed supply port 21*a* is covered with the valve 24 again.

As shown in FIG. 14, a connector 25 electrically connected to the IC 16 of the ink cartridge 10 is stuck to the upper portion of the back of the inside of the housing 153. The connector 25 is connected to the FFC 123, so that the control unit of the ink-jet printer 100 is able to write and read information about ink to and from the IC 16 of the ink cartridge 10. Further, a latch pawl 153*b* for latching onto the latch projection 17 of the ink cartridge 10 in a manner communicating with a cam 159 or releasing the latched condition is formed in the central portion of the top face of the housing 153.

The control lever 154 provided within the holder body 151 is as shown in FIG. 12 disposed vertically pivotably along a guide groove 151*a* provided in the vertical direction of the holder body 151. The control lever 154 vertically pivots whereby to electrically control the writing of information about ink to the IC 16 disposed in the ink cartridge 10 and also to mechanically control the drawing out and pushing the ink cartridges 10 from and into the respective housings 153.

More specifically, when the control lever 154 is positioned at the uppermost end, information about ink is prohibited from being written to the IC 16 disposed on each ink cartridge 10 but the ink cartridge 10 is allowed to be drawn out from and pushed into the housing 153 of the ink cartridge 10, whereas when the control lever 154 is positioned at the lowermost end, information about ink is allowed to be written to the IC 16 disposed on the ink cartridge 10 but the ink cartridge 10 is not allowed to be drawn out from and pushed into the housing 153.

Large-sized ink cartridges are made usable by providing the control lever 154 having the functions above. In other words, the writing of information about ink to the ICs disposed on each ink cartridge has been controlled by the opening and closing of the cover of the ink cartridge holder. However, the large-sized ink cartridges are inevitably protruded from the front of the holder body when such large-sized ink cartridges are set in the holder body. Consequently, the writing of information about ink to the IC disposed on each cartridge has remained uncontrollable because the cover of the ink cartridge holder cannot be closed.

On the contrary, the wiring of information about ink to the ICs 16 disposed on the ink cartridges 10 according to this embodiment of the invention is controlled by pivoting the control lever 154 of the ink cartridge holder 150 as mentioned above. Therefore, the writing of information about ink to the ICs disposed in the large-sized ink cartridges is controllable even though the cover 152 cannot be closed as the large the large-sized ink cartridges set in the holder body protrude from the front of the holder body.

Ink within the ink cartridges 10 of different colors contained in the ink cartridge holder 150 is as described above pressurized by the ink pressurizing/supplying device before being sent to the recording heads 121. For this reason, as ink can be supplied wherever the ink cartridge holder 150 may be disposed, the ink cartridge holder can freely be set anywhere unlike the conventional ink-jet printer utilizing a difference in head and thus making it necessary to dispose the ink cartridge holder above the carriage.

Figure 16:
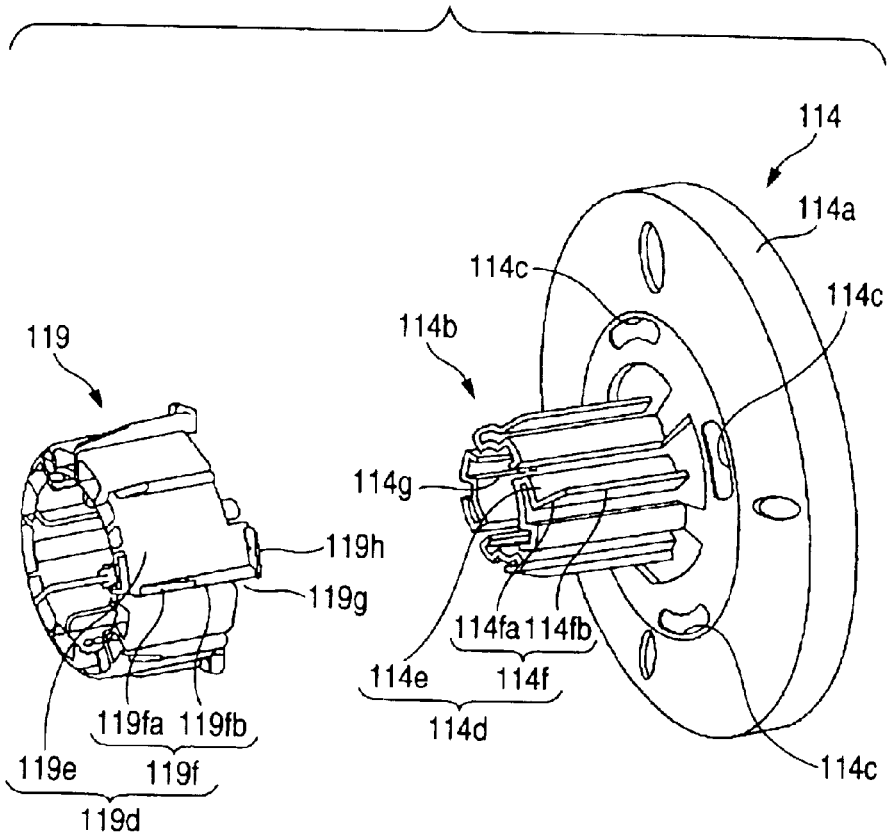
FIG. 16 is a detailed perspective view of the roll paper supporting member of the ink-jet printer of FIG. 1 and an adapter fitted thereto.
Figure 17:
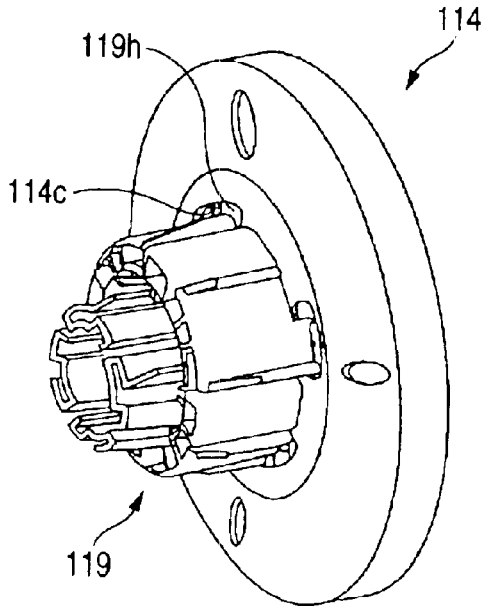
FIG. 17 is a detailed perspective view showing the roll paper supporting member fitted into the adapter.

FIG. 16 is a detailed perspective view of the roll paper supporting member 114 and an adapter that is mounted thereon; and FIG. 17, a detailed perspective view showing the roll paper supporting member 114 with the adapter mounted thereon. The roll paper supporting member 114 is arranged so that a shaft core 114*b* fitted into the end portion of the hollow shaft portion of the roll paper is formed integrally with one face side of a flange 114*a* in a projected condition. Engagement holes 114*c* for engagement pawls 119*h* formed on one edge face of an adapter 119 are bored in the flange 114*a*.

The shaft core 114*b* is in the form of a hollow cylinder and on its outer peripheral face, a plurality of axially-extended ribs 114*d* for assisting the shaft core 114*b* to fit into the end portion of the hollow shaft portion of roll paper having an inner diameter of two inches, for example, and for holding the end portion thereof from inside are formed integrally with the shaft core 114*b* at predetermined intervals in the circumferential direction. Each rib 114*d* is provided with a plate spring 114*e* C-shaped in section that is formed integrally with the outer peripheral face of the shaft core 114*b* and a holding portion 114*f* formed integrally therewith in a manner projecting from the front end of the plate spring 114*e*. In addition, the holding portion 114*f* is formed with a tilted guide face 114*fa* and a flat holding face 114*fb*. A slit 114*g* axially extended is formed between the ribs 114*d*.

With the arrangement above, the guide faces 114*fa* of the holding portions 114*f* guide the inner peripheral face of the end portion of the hollow shaft portion of the roll paper having an inner diameter of two inches, for example, and as the plate springs 114*e* then undergo elastic deformation, the shaft core 114*b* is readily fitted into the end portion of the hollow shaft portion of the roll paper. When the holding faces 114*fb* of the holding portions 114*f* hold the inner peripheral face of the end portion of the hollow shaft portion of the roll paper, it is ensured that the end portion of the hollow shaft portion of the roll paper is held because the restoring force of the plate springs 114*e* works. Even though the inner diameter of the hollow shaft portion of the roll paper varies, the variation is made absorbable as each rib 114*d* is warped diametrically by the slit 114*g*.

The adapter 119 is a hollow cylindrical member and on its outer peripheral face, a plurality of axially-extended ribs 119*d* for assisting the adapter 119 to fit into the end portion of the hollow shaft portion of roll paper having an inner diameter of three inches, for example, and for holding the end portion thereof from inside are formed integrally with the adapter 119 at predetermined intervals in the circumferential direction. Each rib 119*d* is provided with a plate spring 119*e* L-shaped in section that is formed integrally with the outer peripheral face of the adapter 119 and a holding portion 119*f* formed integrally therewith in a manner projecting from the front end of the plate spring 119*e*. In addition, the holding portion 119*f* is formed with a tilted guide face 119*fa* and a flat holding face 119*fb*. Slits 119*g* axially extended are formed in the adapter 119. Moreover, the latch pawls 119*h* are formed in the end portions on the side of the holding faces 119*fb* of the ribs 119*d*.

With the arrangement above, the guide faces 119*fa* of the holding portions 119*f* guide the inner peripheral face of the end portion of the hollow shaft portion of the roll paper having an inner diameter of three inches, for example, and as the plate springs 114*e* then undergo elastic deformation, the adapter 119 is readily fitted into the end portion of the hollow shaft portion of the roll paper. When the holding faces 114*fb* of the holding portions 114*f* hold the inner peripheral face of the end portion of the hollow shaft portion of the roll paper, it is ensured that the end portion of the hollow shaft portion of the roll paper is held because the restoring force of the plate springs 114*e* works. Even though the inner diameter of the hollow shaft portion of the roll paper varies, the variation is made absorbable as the adapter 119 is warped diametrically by the slits 119*g*, so that the adapter 119 can be firmly tightened around the shaft core 114*b*.

With the adapter 119 thus arranged, it is unnecessary to have a complete set of roll paper supporting members to be used every time the hollow shaft portions of the roll-like recording medium differ in inner diameter. As the size of such an adapter 119 can be made at least smaller than the size of the roll paper supporting members 114, the adapter 119 is easily stocked under control.

Although the invention has been described as what is susceptible of wide application, the invention is not limited to the above-described embodiment thereof but may needless to say be changed and modified within the scope of the invention as described in claims. Although a description has been given of an ink-jet printer as a liquid fixing apparatus by way of example, the invention is not limited to the ink-jet printer but may be applicable to facsimiles, copying machines and so on as long as roll paper is usable therein.

As set forth above, it is unnecessary to have a complete set of roll paper supporting members to be used for a roll-like fixing-media holding device and liquid fixing apparatus every time the hollow shaft portions of the roll-like fixing medium differ in inner diameter. As the size of such an adapter can be made at least smaller than the size of the roll paper supporting members, the adapter is easily stocked under control.

What is claimed is:

1. A roll-like fixing-medium holding device for rotatably holding a roll-like fixing medium, comprising:

at least one adapter capable of attaching a hollow shaft portion of the roll-like fixing medium whose inner diameter differs from an inner diameter of a regular roll-like fixing medium; and a supporting member which is fitted in an end portion of the hollow shaft portion so as to support the roll-like fixing medium;

wherein said adapter is separately formed from said supporting member and is detachably mounted on said supporting member.

2. A roll-like fixing-medium holding device according to claim 1, wherein slits axially extended are formed in the adapter so that the adapter is elastically deformable in a diametric direction of said adapter.

3. A liquid fixing apparatus having the roll-like fixing-medium holding device according to claim 1.

4. A roll-like fixing medium holding device for rotatably holding a roll-like fixing medium, comprising:

at least one adapter capable of attaching a hollow shaft portion of the roll-like fixing medium whose inner diameter differs from an inner diameter of a regular roll-like fixing medium; and a supporting member which is fitted in an end portion of the hollow shaft portion so as to support the roll-like fixing medium;

wherein a first fixing medium including a hollow shaft portion having a first inner diameter is attachable to said supporting member without mounting said adapter on said supporting member, and a second fixing medium including a hollow shaft portion having a second inner diameter, which is different from the first inner diameter, is attachable to said supporting member by mounting said adapter on said supporting member.

5. A roll-like fixing-medium holding device according to claim 4, wherein slits axially extended are formed in the adapter so that the adapter is elastically deformable in a diametric direction of said adapter.

6. A liquid fixing apparatus having the roll-like fixing-medium holding device according to claim 4.

7. A roll-like fixing-medium holding device for rotatably holding a roll-like fixing medium, comprising:

at least one adapter capable of attaching a hollow shaft portion of the roll-like fixing medium whose inner diameter differs from an inner diameter of a regular roll-like fixing medium; and a supporting member for supporting the roll-like fixing medium;

wherein an engagement hole is formed on a flange of said supporting member and an engagement pawl is formed on one edge face of said adapter and said engagement pawl is retained in said engagement hole when said adapter is mounted on said supporting member.

8. A roll-like fixing-medium holding device according to claim 7, wherein slits axially extended are formed in the adapter so that the adapter is elastically deformable in a diametric direction of said adapter.

9. A liquid fixing apparatus having the roll-like fixing-medium holding device according to claim 7.

10. A roll-like fixing-medium holding device comprising:

a shaft which is inserted into a hollow shaft portion of a roll-like fixing medium;

a supporting member which is fitted in an end portion of the hollow shaft portion of the roll-like fixing medium with the shaft inserted thereinto so as to support the roll-like fixing medium; and an adapter which is mounted on said supporting member and inserted in the hollow shaft portion of the roll-like fixing medium, said adapter capable of attaching the hollow shaft portion whose inner diameter differs from an inner diameter of a regular roll-like fixing medium.

11. A roll-like fixing-medium holding device according to claim 10, slits axially extended are formed in the adapter so that the adapter is elastically deformable in a diametric direction of the adapter.

12. A roll-like fixing-medium holding device according to claim 10, wherein said adapter is separately formed from said supporting member and is detachably mounted on said supporting member.

13. A roll-like fixing-medium holding device according to claim 10, wherein a first fixing medium including a hollow shaft portion having a first inner diameter is attachable to the supporting member without mounting said adapter on said supporting member, and a second fixing medium including a hollow shaft portion having a second inner diameter, which is different from the first inner diameter, is attachable to said supporting member by mounting said adapter on said supporting member.

14. A roll-like fixing-medium holding device according to claim 10, wherein an engagement hole is formed on said supporting member and an engagement pawl is formed on one edge face of said adapter and said engagement pawl is retained in said engagement hole when said adapter is mounted on said supporting member.

15. A roll-like fixing-medium holding device according to claim 10, wherein said supporting member includes:

a flange; and a shaft core which is fitted into the end portion of the hollow shaft portion of the fixing medium, and which is formed integrally with one side face of the flange.

16. A roll-like fixing-medium holding device according to claim 10, wherein said adapter is formed substantially as a hollow cylinder and a plurality of ribs extending an axial direction of said adapter are formed on an outer peripheral face of said adapter so as to guide an inner peripheral face of the hollow shaft portion.

17. A roll-like fixing-medium holding device according to claim 16, wherein each of said ribs provided on said adapter is formed integrally with the outer peripheral face of said adapter and includes a flexible plate spring portion, a holding portion projecting from one end of said plate portion and a guide face formed on said holding portion.

18. A roll-like fixing-medium holding device according to claim 10, wherein said supporting member further includes a shaft core that is formed substantially as a hollow cylinder, and a plurality of ribs extending an axial direction of said shaft core are formed on an outer peripheral face of said shaft core so as to guide an inner peripheral face of the hollow shaft portion.

19. A roll-like fixing-medium holding device according to claim 18, wherein each of said ribs provided on said shaft core is formed integrally with said shaft core and includes a flexible plate spring portion, a holding portion projecting from one end of said plate spring portion and a guide face formed on said holding portion.

20. A liquid fixing apparatus having the roll-like fixing medium holding device according to claim 10.

* * * * *